US006465949B1

(12) United States Patent
Miahara et al.

(10) Patent No.: US 6,465,949 B1
(45) Date of Patent: Oct. 15, 2002

(54) INCANDESCENT LAMP FILAMENT

(75) Inventors: Katsuhiko Miahara; Hiroshi Sugahara; Masashi Dan, all of Himeji; Minoru Asao, Tatuno; Yutaka Yamanizu, Himeji, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/743,805

(22) PCT Filed: May 22, 2000

(86) PCT No.: PCT/JP00/03249

§ 371 (c)(1),
(2), (4) Date: Jan. 22, 2001

(87) PCT Pub. No.: WO00/72358

PCT Pub. Date: Nov. 30, 2000

(30) Foreign Application Priority Data

May 24, 1999 (JP) ..... 11-144123

(51) Int. Cl.[7] ..... H01J 1/62

(52) U.S. Cl. ..... 313/493; 313/631

(58) Field of Search ..... 313/493, 574, 313/631, 270

(56) References Cited

FOREIGN PATENT DOCUMENTS

| | | |
|---|---|---|
| JP | 02-002788 | 1/1990 |
| JP | 04-073859 | 3/1992 |

*Primary Examiner*—Vip Patel
(74) *Attorney, Agent, or Firm*—Nixon Peabody LLP; David S. Safran

(57) ABSTRACT

In order to prevent a short lifetime of a lamp experiencing an extending downward of the coil under application stress when the coil is in a vertical configuration, there is provided an incandescent lamp in which a filament is stored in a bulb, and the filament is arranged in a vertical orientation and held by supporting element, where the filament is composed of a double coil in which a primary coil having a strand wound thereon is doubly wound, and the primary coil is more closely wound at the upper part of the filament than at the lower part of the filament.

4 Claims, 3 Drawing Sheets

INCANDESCENT LAMP FILAMENT

TECHNICAL FIELD

This invention relates to an incandescent lamp that is turned on with a coil axis of a filament being directed in a vertical direction, and, for example, an incandescent lamp filled with an inert gas containing halogen.

BACKGROUND ART

In recent years, the range of utilization of incandescent lamps acting as a heat source as well as a light source for a general illumination purposes and for an optical equipment and the like has expanded, and incandescent lamps have been used in a heating device for heat treatment such as rapid heating, high temperature holding and rapid cooling or the like. In such an incandescent lamp as above, one in which a double coil is applied as a filament is preferably used.

FIG. 3 illustrates one example of a double coil type incandescent lamp. A filament 20 is formed of a double coil made such that a tungsten wire is applied as a strand, and a primary coil having this wire wound at an equal pitch is further wound into a double form at an equal pitch. The filament 20 is constructed such that a pair of upholding parts 30, 30' also acting as inner leads are connected to both ends of the filament, and the filament 20 is arranged in a state in which the filament is being hung in a hollow manner within the bulb along the axis of the bulb.

This incandescent lamp 10 was lit and used in a vertical orientation, resulting in that the coil of the filament hung down as the turn-on time expired, and so the incandescent lamp had the disadvantage of the double coil also being extended downwards and being easily deformed.

That is, the incandescent lamp as described above is made such that the filament is oriented in a vertical direction, i.e. an axis of the double coil is oriented in a vertical direction and the net-weight of the coil can be set equated with stress, so that the incandescent lamp has the feature of the load applied to the coil being lowest at the lower end of the filament and having a maximum at the upper end where it is gradually increased as the load is directed more upwardly compared with the lower end thereof.

Due to this fact, although the stress is scarcely generated at the lower end of the filament and prevents the coil from hanging out, the load is increased in a more upward position from the lower end, resulting in that the coil remarkably hangs down, and the largest extension of the coil is found at the upper end of the filament.

In case of the aforesaid filament in the incandescent lamp, the upper end and the lower end thereof are connected to the upholding parts and fixed there so that the number of turns of the double coil and the length of the filament do not change. Accordingly, due to the aforesaid reasons, when the coil hangs down, the pitch of the double coil is gradually narrowed toward the lower part, finally resulting in that the pitch becomes zero and the adjoining upper primary coil and lower primary coil of the double coil get in contact with each other and a short-circuit state or melt-cut state of the filament and the like occur.

In particular, in case the incandescent lamp was used under such a high temperature as one in which the temperature of the filament was 2600° C., for example, and its turning-on or turning-off was repeated within a short period of time to light it in a pulse-like manner, a hang-down of the coil occurred remarkably, resulting in the problem of a short lifetime of the lamp.

In view of the aforesaid circumstances, the upholding parts were fixed to not only the upper end and the lower end of the filament but also over its longitudinal direction, and it was possible to provide means for preventing a hang-down of the coil. However, in accordance with this method, the structure of the filament portion becomes complicated and its productivity becomes inferior.

Further, there is the circumstance that if the incandescent lamp is utilized as a heat source, in particular, when the filament length is approximately the same as the diameter of the double coil, the arrangement of many upholding parts at the filament light emitting section is not preferable due to the fact that the thermal efficiency of the lamp is reduced by this arrangement.

In view of the foregoing, it is an object of the present invention to prevent the lifetime of an incandescent lamp from being reduced due to the coil hanging down while using a simple construction and to provide an incandescent lamp having a long lifetime in use.

DISCLOSURE OF INVENTION

This invention provides an incandescent lamp in which a filament is stored in a bulb and the filament is held by upholding parts while being oriented in a vertical direction, characterized in that the filament is comprised of a double coil in which a primary coil having a strand wound therein is wound in a double form and the primary coil is more closely wound at the upper part of the filament as compared with that of the lower part of the filament.

With such an arrangement as above, since the shearing stress applied to the coil is reduced when a load is applied to the double coil, resistance against a hang-down characteristic of the coil at the upper part of the filament is increased, the double coil hardly hangs out even if the load applied to it is high, resulting in that a deformation of the filament can be prevented and it becomes possible to prevent the coils from getting in contact with each other. Further, in accordance with the present invention, it becomes possible to restrict the hang-down of the coil and to obtain a long lifetime of the lamp by a simple construction without changing the other configuration of the lamp except for the filament.

BEST MODE FOR CARRYING OUT THE INVENTION

Referring now to the accompanying drawings, one preferred embodiment of the present invention will be described as follows.

Figure 1:
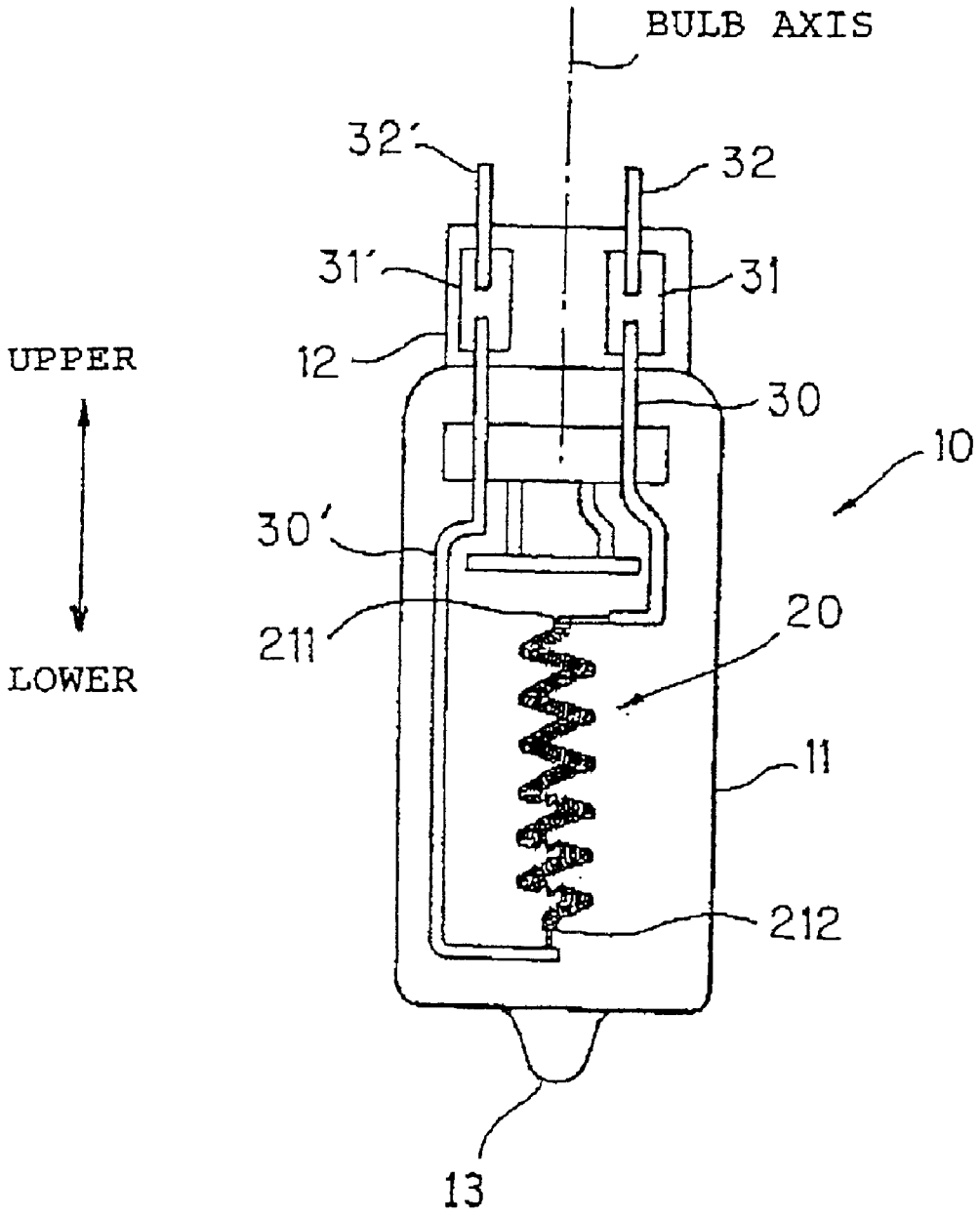
FIG. 1 is a sectional view showing an example of a preferred incandescent lamp of the present invention.

FIG. 1 is an illustrative sectional view showing an incandescent lamp of the preferred embodiment of the present invention. In FIG. 1, the incandescent lamp 10 is a so-called one end sealed type halogen lamp constructed such that a double-coil type filament 20 is arranged inside a glass bulb 11, inert gas containing halogen is filled therein and at the same time a sealing part 12 is formed at one end of the bulb 11 and a tip part 13 of a residual evacuation tube is formed at the other end of the bulb.

This incandescent lamp 10 is made such that when the lamp is actually used, a ceramic base, although not shown, for example, is installed at the sealing part 12, the lamp is held in a vertical orientation with the base being placed upward, and then the lamp is lit.

Upholding parts 30, 30' acting as inner lead wires are connected to both ends of the filament 20. The upholding parts 30, 30' are connected to molybdenum foils 31, 31' embedded in the sealing part 12. The molybdenum foils 31, 31' are connected to outer lead rods 32, 32' projecting out of the sealing part 12.

The double coil 22 constituting the filament 20 is made such that a tungsten wire with a filament strand, for example, is wound into a diameter of $\phi$ 1.0 to form a primary coil 21, and then this primary coil is wound a second time with a coil diameter of $\phi$=4.8. This coil is applied in its use with a filament length of about 9.8 mm and with a number of turns of 6 to 7 as the number of windings, for example.

Figure 2A:
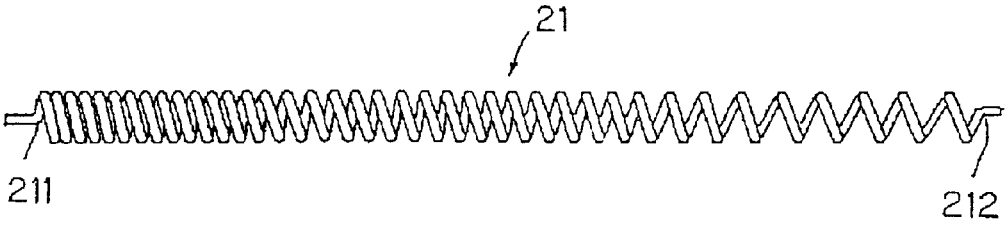
FIGS. 2(*a*) and 2(*b*) are enlarged illustrations showing the coil of FIG. 1 in more detail, wherein FIG. 2(*a*) is a side enlarged view of the primary coil and FIG. 2(*b*) is a side enlarged view of the double coil.
Figure 2B:
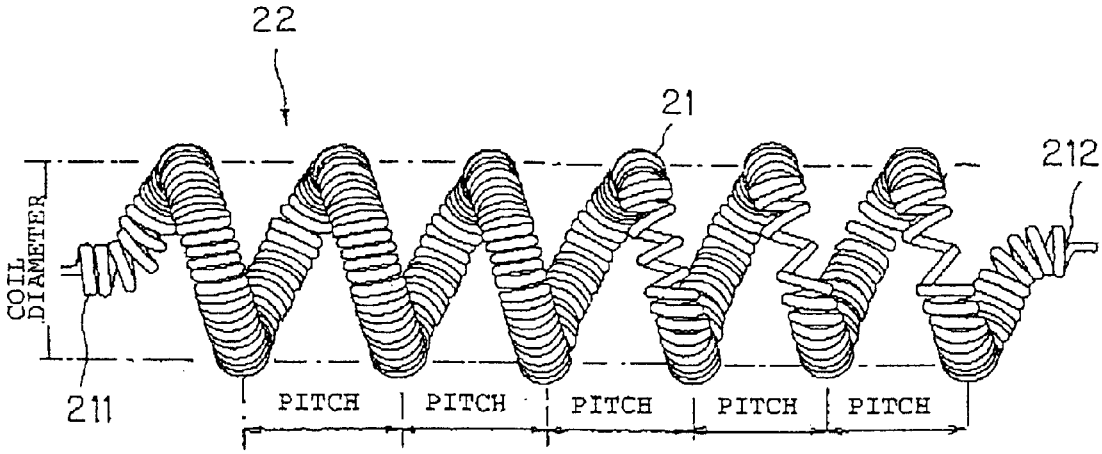
Figure 3:
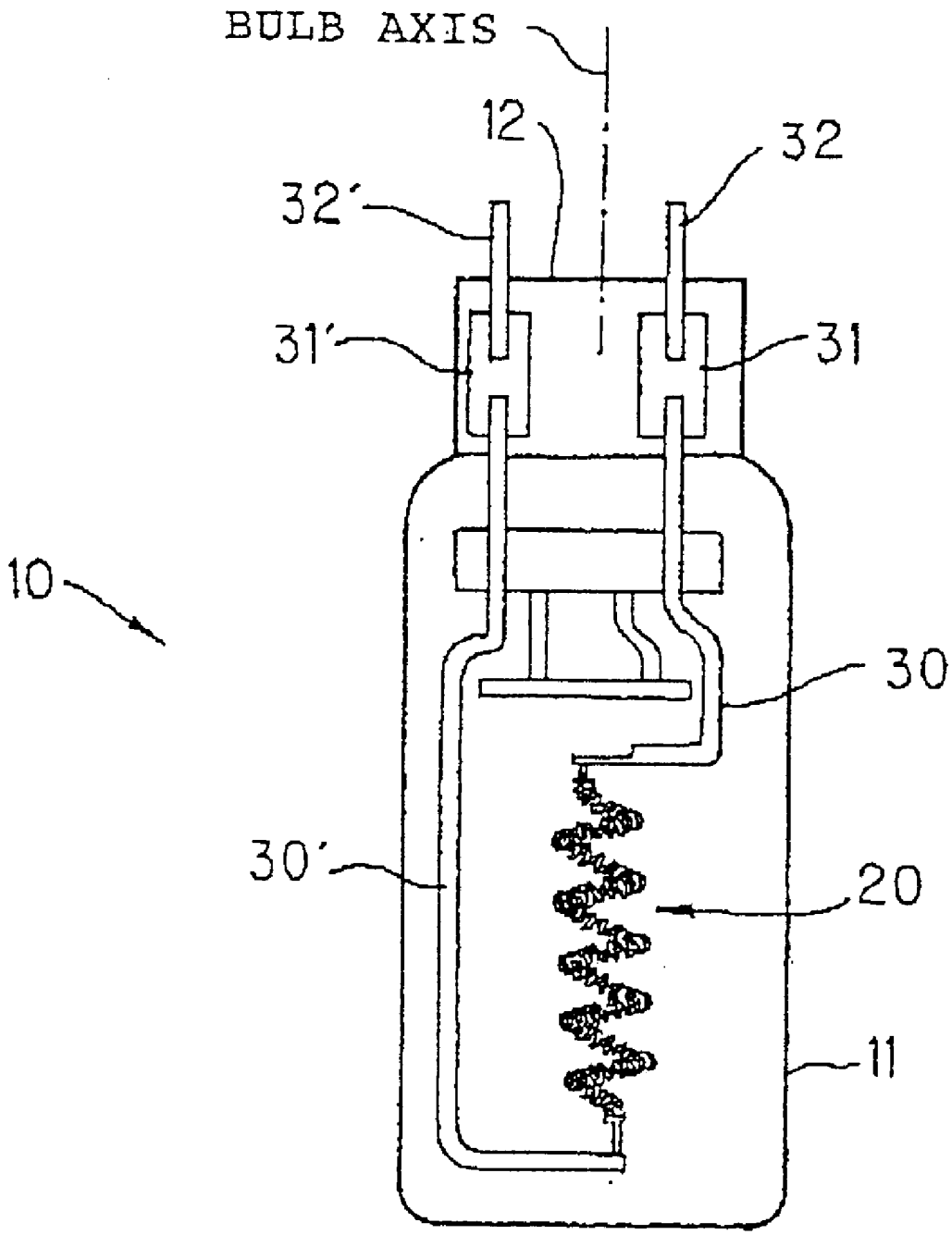
FIG. 3 is a sectional view showing a prior art double-coil type incandescent lamp.

Referring next to FIG. 2(*a*) and FIG. 2(*b*), the constitution of the coil will be described as follows. The primary coil 21 is wound such that its pitch is 0.29 mm at the first end 211, and the pitch is increased by always 15% of the strand every time the coil is wound subsequently by ten turns, and as shown in FIG. 2(*a*), the primary coil is closely wound at the one end 211, its pitch is gradually increased toward the other end 212, and further the coil is wound coarsely at the other end 212.

FIG. 2(*b*) shows a double coil manufactured by applying the aforesaid primary coil 21. This double coil is wound at an equal pitch with the pitch being 1.5 mm, for example.

The double coil 22 having the aforesaid constitution is made such that each of the upholding parts 30, 30' is connected to one end 211 and the other end 212, wherein, as shown in FIG. 1, the double coil 22 is arranged within the bulb 11 in such a way that one end 211 of the coil is positioned at the upper side of the lamp (the side where the sealing part 12 is present) and the other end 212 of the coil is positioned at the lower side of the lamp.

With such an arrangement as above, since the primary coil of the double coil is closely wound at the filament top, resistance against the hang-down of the coil at this part is increased and the hang-down of the coil is hardly produced even if the load applied to the filament is high as compared with that of the lower side of the filament.

In accordance with the present invention it becomes possible to increase the resistance against the hang-down of the coil in correspondence with the load applied to the filament by using the simple construction of the primary coil part of the double coil being closely wound at the upper part rather than the lower part of the filament without changing the length of the filament or without changing the number of turns of the double coil as well as without changing other configurations of the lamp. Thus, it becomes possible to restrict the hang-out of the coil at the upper part of the filament and to further prevent the coil pitch at the lower part of the filament from being narrowed.

As a result, it is possible to prevent the upper and lower adjoining double coils from getting in contact with each other, and further it becomes possible to prevent the occurrence of a short-circuit and melt-cut of the filament, resulting in that a long lifetime of the lamp can be extended.

Further, the present invention is constructed such that a pitch of the primary coil constituting the double coil of the filament is displaced roughly or closely in consideration of an extension of the double coil of the filament, and other various modifications of the present invention can be carried out for other constitutions. For example, it is also applicable that the double coil has no equal pitch, but the double coil may be displaced in an axial direction. In this case, if the pitch of the double coil at the upper side of the filament is made narrow and the pitch of the lower side of the filament is made wide, it takes much time until both coils get in contact with each other due to the fact that the pitch of the double coil is wide also when the double coil at the upper part of the filament is elongated and hangs down in a downward direction, resulting in that it is possible to avoid a short-circuit of the filament as well as it being melt cut, and a long lifetime of the lamp can be realized.

In addition, the shape of the double coil can be changed into various shapes, and it is also possible to perform an axial displacement of the diameter of the double coil when its outer appearance is not wound in a column-like manner as shown in FIG. 2(*b*), and for example, the primary coil is wound in such a way that the diameter of the double coil is gradually increased to make a conical double coil. Further, in case a conical double coil is used, if the one end of the double coil with a small diameter is arranged at the upper end of the filament and in turn the other end of the double coil with a large diameter is arranged at the lower end of the filament, this arrangement is preferable due to the fact that a shearing stress applied to the double coil at the upper part of the filament is low and the resistance of the coil against hanging down is increased.

Industrial Applicability

As described above, the incandescent lamp of the present invention is made such that the primary coil of the filament comprised of a double coil is more closely wound at the upper part of the filament than at the lower part of the filament so that, while the lamp is of a simple configuration, the resistance of the coil against it hanging out can be increased in response to a load of the filament, resulting in that the hang-down of the filament at the upper part of the filament can be restricted and the deformation of the coil can be prevented, and so it becomes possible to prevent a short-circuit state and a melting cut of the filament, and a long lifetime of the lamp can be attained.

Further, the incandescent lamp of the present invention is applied to a general type of incandescent lamps which is lit with a coil axis of the filament being directed in a vertical orientation; it is useful as an incandescent lamp where a hang-down of the filament may easily be produced in which a temperature of the filament is 2600° C. or more, for example, and its turning-on or turning-off is repeated within a short period of time at such a high temperature as above; and the present invention is most suitable for an incandescent lamp utilized in a rapid thermal process (RTP) in manufacturing of a semiconductor device, for example, which is filled with an inert gas containing halogen.

What is claimed is:

1. An incandescent lamp comprising a coil filament assembled in a vertical orientation within a bulb, supporting elements within the bulb for supporting both an upper and a lower end of the coil filament, wherein said coil filament comprises a double coil comprising a primary coil having a strand wound thereon that is doubly wound, such that said doubly wound primary coil is more closely wound at the upper end of said coil filament as compared with that of the lower part of said filament.

2. An incandescent lamp as set forth in claim 1, wherein the pitch of the doubly wound primary coil is 0.29 mm at the upper end of the coil filament and the pitch increases as the doubly wound primary coil is wound toward the lower end of the coil filament.

3. An incandescent lamp as set forth in claim 2, wherein the pitch of the doubly wound primary coil is increased by 15% for every ten primary coil windings.

4. An incandescent lamp as set forth in claim 1, wherein the diameter of the doubly wound primary coil of the coil filament increases from the upper end of the coil filament to the lower end of the coil filament such that the coil filament has a conical shape.

* * * * *